US006200159B1

(12) United States Patent
Chou

(10) Patent No.: US 6,200,159 B1
(45) Date of Patent: Mar. 13, 2001

(54) MULTI-DECK ELECTRIC OUTLET ASSEMBLY

(76) Inventor: Jonie Chou, 9F-4, No. 232, Chung Ho Road, Chung Ho City, Taipei Hsien (TW)

( * ) Notice: Subject to any disclaimer, the term of this patent is extended or adjusted under 35 U.S.C. 154(b) by 0 days.

(21) Appl. No.: 09/437,293

(22) Filed: Nov. 9, 1999

(30) Foreign Application Priority Data

Oct. 15, 1999 (CN) ..... 99 2 51412

(51) Int. Cl.[7] ..... H01R 13/60; H01R 25/01

(52) U.S. Cl. ..... 439/535; 439/650; 439/501; 174/48

(58) Field of Search ..... 439/535, 650, 439/651, 652, 653, 654, 501, 502, 456, 954; D13/139.8; 174/53

(56) References Cited

U.S. PATENT DOCUMENTS 4,930,047 * 5/1990 Peterson ..... 439/535
5,117,122 * 5/1992 Hogarth et al. ..... 439/535
5,122,069 * 6/1992 Brownlie et al. ..... 439/535
5,516,298 * 5/1996 Smith ..... 439/535
5,838,538 * 11/1998 Yee ..... 361/683
5,848,915 * 12/1998 Canizales ..... 439/650
5,924,892 * 7/1999 Ferracina ..... 439/535
5,989,060 * 11/1999 Coile et al. ..... 439/650
6,004,157 * 12/1999 Glass ..... 439/535

* cited by examiner

*Primary Examiner*—Paula Bradley
*Assistant Examiner*—James Harvey
(74) *Attorney, Agent, or Firm*—Dougherty & Troxell

(57) ABSTRACT

A multi-deck electric outlet assembly, which includes a base, a body mounted on the base, the body having a series of steps raised one above another at one side, and a landing at the topside thereof, the steps each having a sloping riser, multiple electric socket units respectively installed in the landing and the risers of the steps and respectively connected to a circuit board at the base, and a power cable inserted through a wire hole on the base and connected to the circuit board.

10 Claims, 4 Drawing Sheets

MULTI-DECK ELECTRIC OUTLET ASSEMBLY

BACKGROUND OF THE INVENTION

The present invention relates to an electric outlet, and more specifically to a multi-deck electric outlet assembly, which comprises a body having a landing and a series of steps, multiple electric socket units respectively installed in the landing and the risers of the steps and connected to a circuit board, which is in turn connected to power supply through a power cable.

A variety of electric outlets have been disclosed for use to provide city power supply to electric/electronic apparatus. In order to provide power supply to a computer system and the related computer peripheral apparatus such as monitor, printer, modem, speaker, scanner, digital camera, etc., multiple electric outlets may be necessary. When multiple movable electric outlets are used with a computer system and the related computer peripheral apparatus, it is difficult to keep the electric outlets and the power cables of the computer system and the related computer peripheral apparatus in order. Further, when a transformer is installed in an electric outlet having multiple electric socket units, it occupies much face space of the electric outlet, and may hinder the application of other electric socket units of the electric outlet.

SUMMARY OF THEM INVENTION

The present invention has been accomplished under the circumstances in view. According to one aspect of the present invention, the multi-deck electric outlet assembly comprises a base, a body mounted on the base, the body having a series of steps raised one above another at one side, and a landing at the topside thereof, the steps each having a sloping riser, multiple electric socket units respectively installed in the landing and the risers of the steps and respectively connected to a circuit board at the base, and a power cable inserted through a wire hole on the base and connected to the circuit board. According to another aspect of the present invention, a power switch and a reset button are provided at one side of the body outside the steps and the landing.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
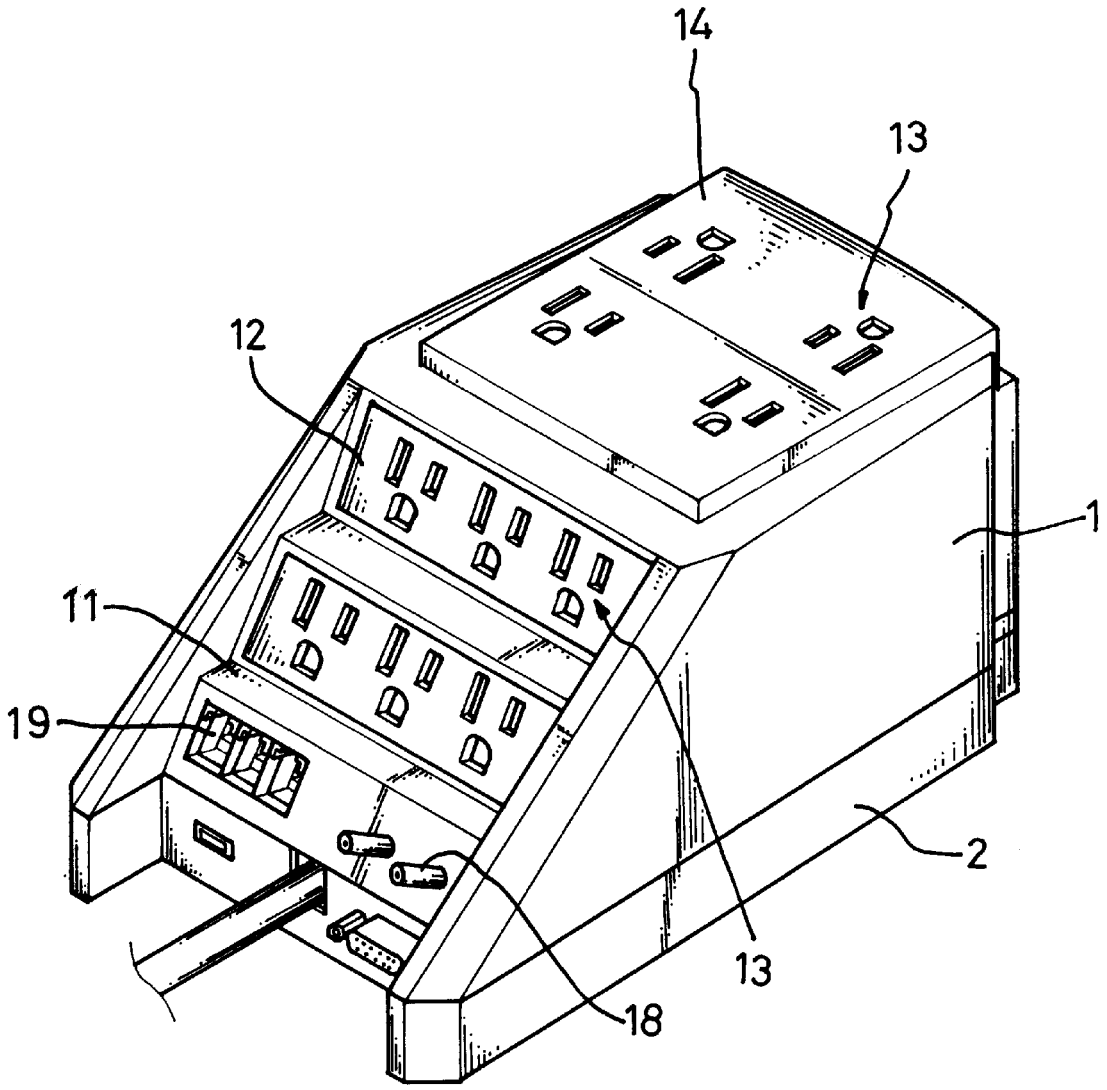
FIG. 1 is an oblique elevation of a multi-deck electric outlet assembly according to one embodiment of the present invention.
Figure 2:
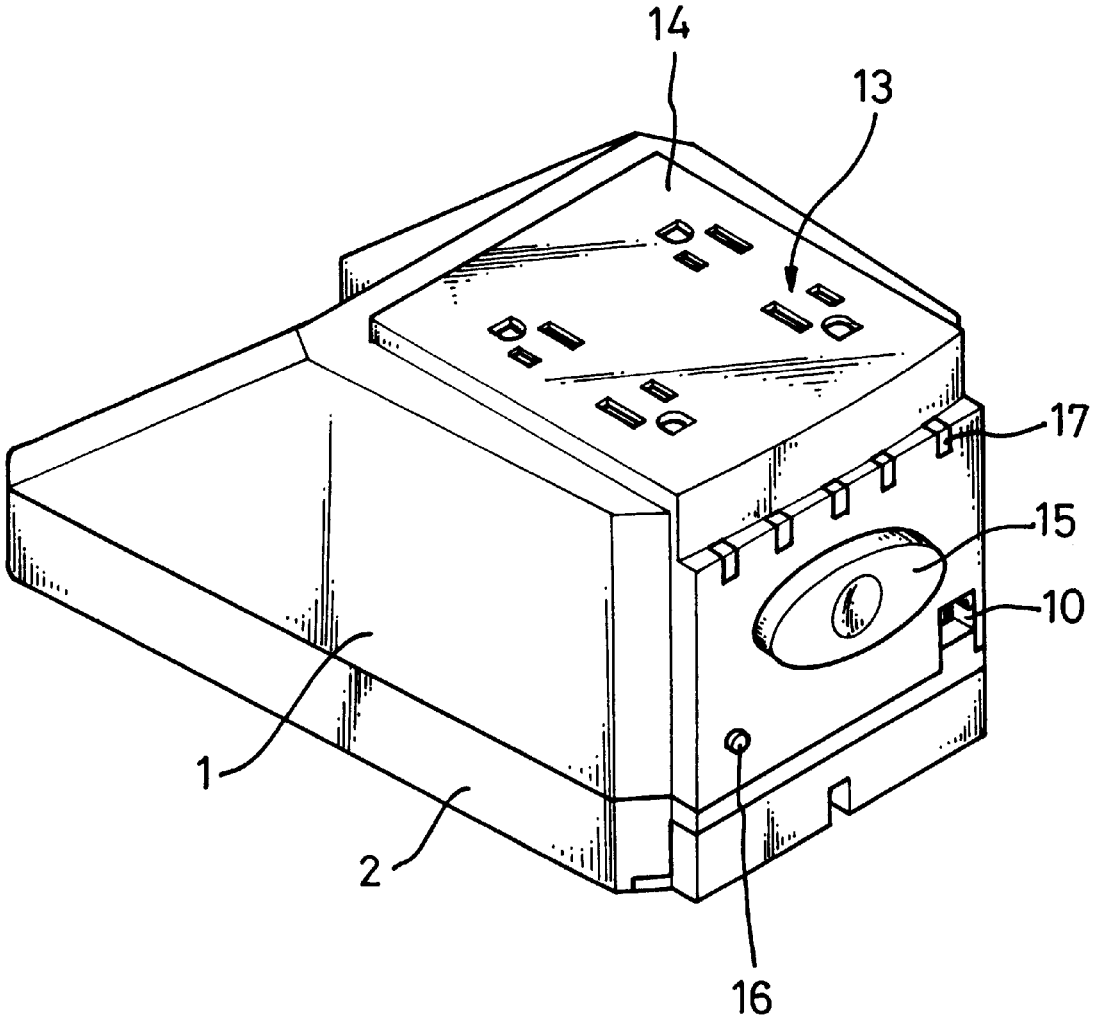
FIG. 2 is another oblique elevation of the multi-deck electric outlet assembly shown in FIG. 1 when viewed from another angle.

Referring to FIGS. 1 and 2, a multi-deck electric outlet assembly in accordance with the present invention is generally comprised of a base 2, and a body 1 mounted on the base 2.

The body 1 comprises a series of steps 11 raised one above another at one side, and a landing 14 at the topside thereof. The steps 11 each comprise a riser 12 sloping forwardly downwards. Multiple electric socket units 13 are formed integral with the risers 12 of the steps 11 and the landing 14. The electric socket units 13, which are formed integral with the landing 14, are arranged in pairs. All electric socket units 13 have respective positive and negative terminals respectively connected to a circuit board (not shown) in the base 2. Because the riser 12 of each step 11 slopes forwardly downwards, an electric plug can easily be connected to one electric socket unit 13 on the riser 12 of one step 11. A power switch 15 and a reset button 16 are provided at one side of the body 1 opposite to the steps 11 Because the power switch 15 is provided at one side of the body 1, it can easily switched on/off by the user with the foot. If the power switch 15 is provided at the landing 14, a falling object may easily trigger it. Indicator lights 17 are mounted on the body 1 and electrically connected to the circuit board in the base 2 for the indication of a variety of statuses including power on/off, grounding, surge wave protection, etc. In order to meet the requirement for protecting network apparatus such as modem, telephone, or cable modem against surge wave, input/output cable connectors 18 and module jacks 19 are provided at the riser 12 of one step 11 and connected to the surge wave protection circuit in the circuit board in the base 2. An electric port 10 is provided for the mounting of the receiver unit of a remote controller for controlling the connection/disconnection of power supply.

The base 2 is fixedly covered on the bottom open side of the body 1, having a wire hole on one side thereof through which a cable is inserted and connected to the circuit board in the base 2.

Figure 3:
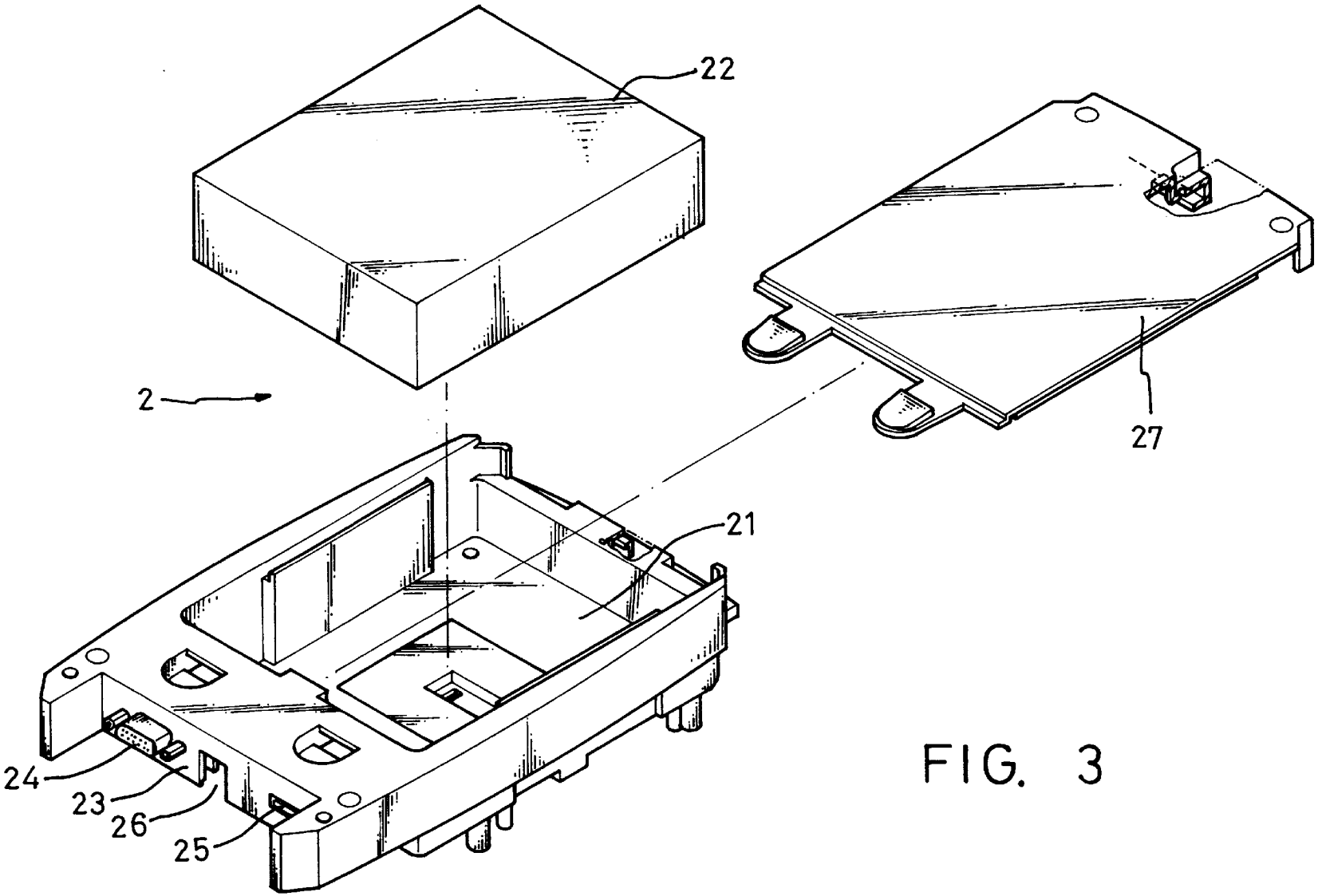
FIG. 3 is an exploded view of the base for the multi-deck electric outlet assembly according to the present invention.

Referring to FIG. 3, the base 2 comprises a casing 21, a storage battery 22 mounted in the casing 21, and a bottom cover plate 27 covered on the casing 21 to hold the storage battery 22 inside the casing 21. The casing 21 comprises a front panel 23, a RS-232 connector 24 and an USB socket 25 mounted in the front panel 23 for connection to a computer. Upon an AC power failure, the storage battery 22 is electrically connected to the computer through the RS-232 connector 24 or USB socket 25, enabling the computer to work continuously, i.e., the storage battery. 22 and the RS-232 connector 24/USB socket 25 form an uninterrupted power supply (UPS) for the computer. The casing 21 further comprises a wire hole 26 for letting the cable pass to the outside.

Figure 4:
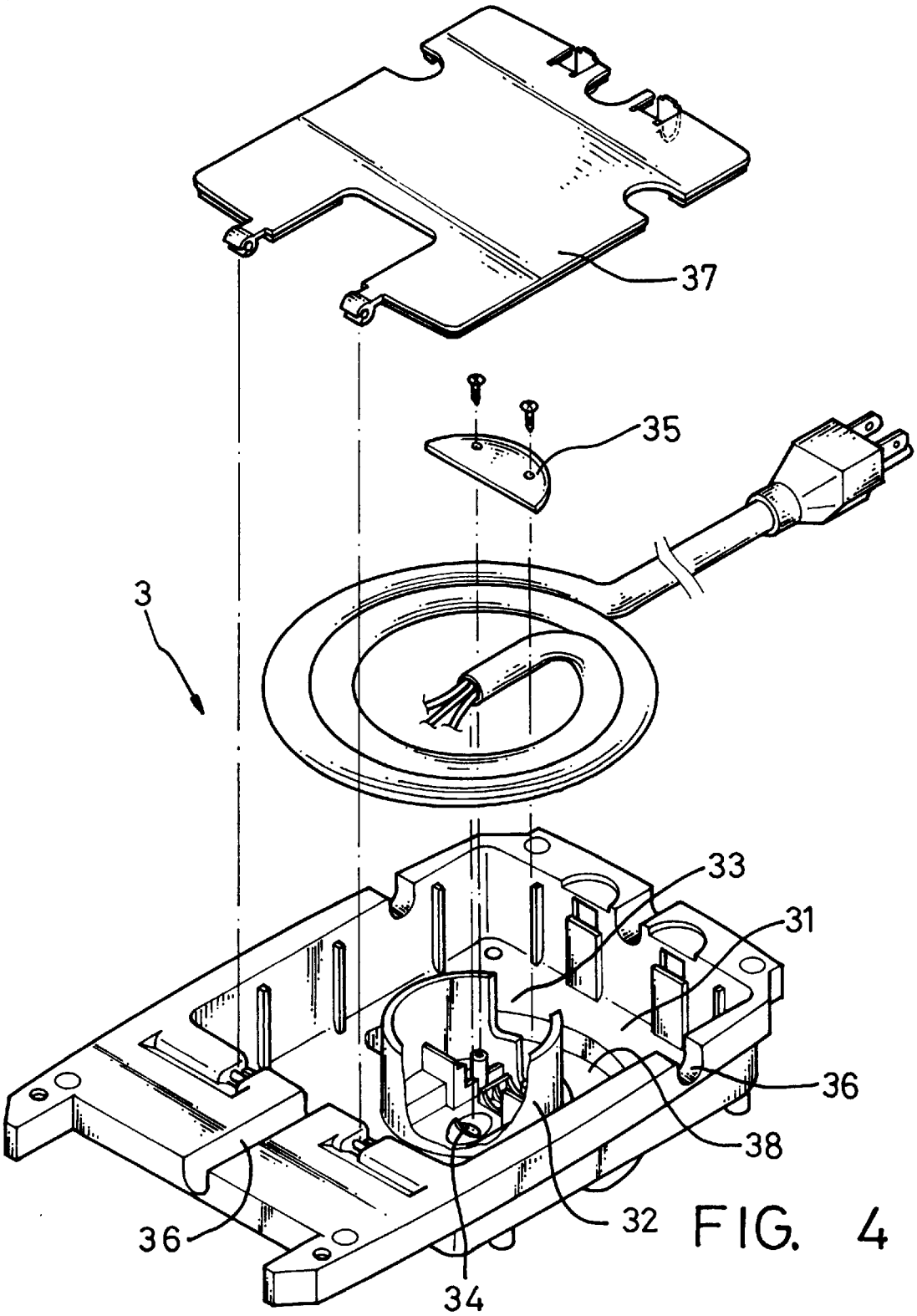
FIG. 4 is an exploded view of an alternate form of the base for the multi-deck electric outlet assembly according to the present invention.

FIG. 4 shows an alternate form of the base. According to this alternate form, the base, referenced by 3, comprises a casing 31, a bottom cover 37 covered on the bottom open side of the casing 31. The casing 31 comprises an upright tube 32 at the center, the upright tube 32 having a side notch 33, through hole 34 through the top wall thereof in communication with the inside space of the upright tube 32, four wire grooves 36 respectively disposed through the four sides thereof, and a recessed portion 38 on the inside around the upright tube 32. When a power cable is inserted through the through hole 34, one end of the power cable is connected to the circuit board (not shown) on one end connected to the inside of the casing 31, the other end of the power cable is extended out of the side notch 33, and then wound round the upright tube 32 and set in the recessed portion 38, and then extended out of one wire groove 36 for connection to power supply. Further, a holding down plate 35 is fixedly mounted inside the upright tube 32 to hold down the power cable.

When in use, electric plugs from different electric or electronic apparatus are respectively connected to the electric socket units 13 at the risers 12 or the landing 14 to obtain power supply, and the cables of the electric plugs are secured together in a good order by a wire binder or the like. A transformer or particular specification of electric plug can be installed in one electric socket unit 13 at the landing 14. Further, the arrangement of the input/output cable connectors 18 and the module jacks 19 at the riser 12 of one step 11 and the arrangement of the power switch 15 and the reset button 16 and the electric port 10 provide the multi-deck electric outlet assembly with added functions.

Although the present invention has been illustrated and described with reference to the preferred embodiment thereof, it should be understood that it is in no way limited to the details of such embodiment but is capable of numerous modifications within the scope of the appended claims.

What the invention claimed is:

1. A multi-deck electric outlet assembly comprising:

a) a body having:

i) an upwardly facing landing surface with a plurality of first electric socket units thereon, each of the plurality of first electric socket units having openings facing upwardly through the landing surface; and, ii) a plurality of spaced apart riser surfaces located below the landing surfaces, each riser surface extending obliquely with respect to the landing surface and each riser surface having a plurality of second electric socket units thereon, the second electric socket units being arranged in a linear array across a width of the associated oblique riser surface, each of the plurality of second electric socket units having openings through the associated oblique riser surface;

b) a base mounted to a lower portion of the body, the base having at least one wire hole; and c) a power cable extending through the at least one wire hole exteriorly of the base for providing electrical power to the first and second electric socket units.

2. The multi-deck electric outlet assembly of claim 1 wherein each riser surface slopes away from the landing surface in a downward direction.

3. The multi-deck electric outlet assembly of claim 1 wherein said body further comprises a power switch and a reset button disposed on a side thereof opposite to said plurality of riser surfaces.

4. The multi-deck electric outlet assembly of claim 3 wherein said power switch is disposed at a peripheral sidewall of said body.

5. The multi-deck electric outlet assembly of claim 1 wherein said body further comprises a plurality of indicator lights respectively located in said base.

6. The multi-deck electric outlet assembly of claim 1 wherein said body further comprises at least one second riser surface extending obliquely to the landing surface and spaced from the plurality of riser surfaces and a plurality of input/output cable connectors and module jacks provided on said at least one second riser surface.

7. The multi-deck electric outlet assembly of claim 1 wherein said body further comprises an electric port for power on/off control through a remote controller.

8. The multi-deck electric outlet assembly of claim 1 wherein said base further comprises a casing and a bottom cover plate on said casing, said casing comprising a front panel with a RS-232 connector and an USB socket mounted in said front panel for connection to a computer.

9. The multi-deck electric outlet assembly of claim 1 wherein aid base further comprises a casing, a bottom cover on said casing, said casing having an upright tube at a center, said upright tube having a side notch, a through hole through a top wall thereof through which said power cable is inserted and extended out said side notch on said upright tube and wound round said upright tube, and a holding down plate fixedly fastened to the inside of said upright tube to hold down one end of said power cable.

10. The multi-deck electric outlet assembly of claim 9 wherein said casing comprises a recessed portion on an inside around said upright tube.

* * * * *